US006569286B1

(12) United States Patent
Withenshaw et al.

(10) Patent No.: US 6,569,286 B1
(45) Date of Patent: May 27, 2003

(54) METHOD FOR THE ALKALINE BLEACHING OF PULP WITH A PEROXYACID BASED OXYGEN BLEACHING SPECIES USING AN AGGLOMERATED BLEACH ACTIVATOR

(75) Inventors: John David Withenshaw, Flintshire (GB); Jane Williams, Flintshire (GB); Mark Ardern Chadwick, Denbighshire (GB); Neil Anthony Turner, Flintshire (GB)

(73) Assignee: Warwick International Group Limited, Flintshire (GB)

( * ) Notice: Subject to any disclaimer, the term of this patent is extended or adjusted under 35 U.S.C. 154(b) by 0 days.

(21) Appl. No.: 09/806,533

(22) PCT Filed: Sep. 22, 1998

(86) PCT No.: PCT/GB99/03178

§ 371 (c)(1),
(2), (4) Date: Aug. 8, 2001

(87) PCT Pub. No.: WO00/19006

PCT Pub. Date: Apr. 6, 2000

(30) Foreign Application Priority Data

Sep. 30, 1998 (GB) ..... 9821165

(51) Int. Cl.[7] ..... D21C 9/16
(52) U.S. Cl. ..... 162/72; 162/76; 162/78
(58) Field of Search ..... 162/78, 72, 76, 162/65; 8/111; 252/186.41

(56) References Cited

U.S. PATENT DOCUMENTS 4,416,606 A 11/1983 Sugano et al.
5,342,542 A 8/1994 Burzio et al.
5,853,428 A * 12/1998 Collins et al. ..... 162/74

FOREIGN PATENT DOCUMENTS

| | | | |
|---|---|---|---|
| EP | 0 764 717 A1 | * | 3/1997 |
| WO | 94/18298 | * | 8/1994 |
| WO | WO 96 02623 | | 2/1996 |
| WO | WO 97 25402 | | 7/1997 |
| WO | WO 98 00504 | | 1/1998 |

* cited by examiner

*Primary Examiner*—Steve Alvo
(74) *Attorney, Agent, or Firm*—Watts Hoffmann Fisher & Heinke

(57) ABSTRACT

Wood and non-wood pulp is bleached by: a) adding an aliquot of agglomerate from a bulk solids dispensing means, advantageously a hopper, to a dilute solution of hydrogen peroxide which is desirably agitated to keep the agglomerate in suspension, the agglomerate comprising: a bleach activator, advantageously tetraacetyl ethylene diamine (TAED); a peroxide soluble binder, preferably polyvinyl alcohol (PVOH); a dispersing system comprising a wetting agent which is a low foaming and does not discolour on exposure to temperatures of up to 120° C. and optionally a salt, preferably sodium acetate, which is highly soluble in hydrogen peroxide; and sequestrant which may additionally or alternatively be added directly to the hydrogen peroxide; b) allowing the TAED to substantially completely react with the hydrogen peroxide; c) adjusting the pH of the bleach solution by adding alkali, preferably caustic soda; and d) bleaching the pulp by contacting it with the bleaching solution under alkaline conditions.

10 Claims, No Drawings

METHOD FOR THE ALKALINE BLEACHING OF PULP WITH A PEROXYACID BASED OXYGEN BLEACHING SPECIES USING AN AGGLOMERATED BLEACH ACTIVATOR

This invention relates to a process for the oxygen bleaching of wood or non-wood pulp using an agglomerated bleach activator to react with hydrogen peroxide to form a pulp bleaching solutions. In particular it relates to the formation of a pulp bleaching solution by the reaction of a specially formulated agglomerate of a crystalline powder of Tetraacetyl ethylene diamine, commonly known as TAED, with excess hydrogen peroxide and the use of that bleaching solution to bleach and delignify pulp.

Oxygen based bleaching is used for pulp bleaching bee of its environmental benefits and oxidising power. Hydrogen peroxide is increasingly being used in oxygen based pulp bleaching.

Although hydrogen peroxide has environmental benefits over chlorine based bleaches it suffers from some performance disadvantages which become particularly important when an existing pulp bleaching sequence is being converted to operate with hydrogen peroxide. One problem is that the degree of whiteness may be reduced compared with the use of chlorine dioxide, this may significantly reduce the value of the pulp.

A second problem which may occur when process conditions are changed to optimise bleaching for use of hydrogen peroxide is that the fibre length deteriorates and there is a corresponding loss of strength in paper produced from the pulp. A third potential problem is the poor delignification performance of hydrogen peroxide when used on its own.

It has been suggested that use of a stronger oxygen based bleach will solve these problems. However, whilst use of equilibrium peracetic acid or Caro's acid improves the bleaching and reduces colour reversion it also introduces problems of handling and dosing peracid in the pulp plant. It is proposed in several patent applications to react at least part of the hydrogen peroxide with a bleach activator thereby generating a peroxyacid based oxygen bleaching species in situ which facilitates improved pulp bleaching and delignification whilst avoiding the hazards of transporting preformed peracid or generating peracid by reaction of hydrogen peroxide and carboxylic acid under forcing conditions. In WO9521290 there is described a process in which peracid is produced in siti by reaction of a bleach activator such as tetraacetylethylenediamine and hydrogen peroxide at a pH less than the $pK_a$ of peracetic acid formed from the reaction of these chemicals. It is stated that in a preferred process the TAED is first dissolved in hot water and then added to the hydrogen peroxide before the reacting mixture is dosed to the pulp. Sequestrant may be added to the pulp before the dosing takes place. It is also stated that conditions must be optimized to ensure that all the TAED is consumed. The chemistry must be carefully controlled to achieve consistent results when using such a powerful bleach as peracetic acid.

In EP456032 there is described a similar pulp bleaching process using alkaline TAED and hydrogen peroxide. Bleaching of the pulp is done in plastic bags and no detail is given of how a scaled up process should be operated.

JP05186989 proposes an alkaline process using a bleach activator such as TAED to give brighter pulp when it is used with oxygen and optionally also with hydrogen peroxide, very few details of the process steps are given and hydrogen peroxide is not used in the examples. It appears that the TAED is mixed as a solid with dry pulp at the start of the bleaching step.

GB2304126 proposes use of TAED activated hydrogen peroxide to delignify pulp. Again the form of the TAED is not specified.

It is conventional in pulp bleaching to use letters to represent stages in a process. Some of the commonly used letters are: C for chlorine, D for chlorine dioxide, Z for ozone, P for peroxide, Pa for peracetic acid, O for oxygen, Q for chelation, and Px for mixed peracids. In this specification the notation $P_A$ is used for the combined addition of a bleaching solution containing hydrogen peroxide and a peracid formed by reaction of the hydrogen peroxide with an agglomerated bleach activator.

TAED is produced as a fine white crystalline powder. Its main use is as a bleach activator for perborate and percarbonate salts in granulated laundry detergent formulations. TAED is normally used in a laundry detergent formulation which contains a large amount of anionic surfactant. In this environment the main problem facing the skilled person is to keep water away from the TAED during storage. To give increased stability and to prevent segregation due to size differences the TAED is therefore agglomerated using one or more binders. A commonly used binder is Sodium Carboxymethylcellulose. The agglomerate typically contains from 80 to about 90% TAED and the remainder is made up of the binder system and optional disintegration and dispersion aids together with other minor components such as pigments, colorants and sequestrants. Sometimes it is beneficial to utilise a co-binder as specified in EP0764717. TAED has also been proposed to be formed into noodles by extrusion. GB1395006 teaches formation of such noodles using 25% by weight of an anionic surfactant mixture including Sodium Laurylsulphate as the binder. Nonionic surfactants with a melting point greater than 35° C. have also been proposed as binders, they are usually heated during the manufacture e.g. using the spray-melt process of DE 2406455. In practice the remainder of the detergent formulation is critical to the successful dispersion and dissolution of the activator as it provides the necessary pH control and surfactants.

WO9418298 describes a bleaching process where an N-acyl bleach activator is reacted with a source of hydrogen peroxide under acid conditions. The product of this reaction may be used in many bleaching and disinfection applications, including pulp and paper bleaching. The activator and other components may be in the form of particles and these particles may be provided by techniques similar to those used in the laundry detergent industry For instance by spray drying liquid slurries; by granulation techniques using binders, for instance synthetic or natural polymers (or derivatives); or by melt blending followed by extrusion or other techniques. A composite product including a bleach activator may also include other additives, especially heavy metal sequestrants and it may include surfactants to act as wetting agents and inorganic salts to act as a diluent or to increase the rate of disintegration or dissolution of the product. The composite product should also include the source of the hydrogen peroxide as well as the bleach activator when it includes the wetting agent. Only two granulated activator particles are exemplified in this document; both contain carboxymethyl cellulose as a binder and neither is used for pulp bleaching.

WO9725402 proposes the use of bleach activators such as TAED for various applications including pulp bleaching. The preferred form of the TAED is a granule, but no details are given of the composition of the granule.

WO9517497 describes a process for preparing a particulate composition containing a liquid bleach activator, a thickener which is preferred to be a polyhydroxy fatty acid amide surfactant and optional filler and non-amide solubilising surfactants. The optional solubilising surfactants may be anionic especially $C_{11-13}$ linear alkylbenzenesulphonates, the optional particulate filler material is selected from a group of materials which includes: sodium acetate, sodium phosphate, sodium acid phosphite and sodium sulphate, however, all the examples use sodium alumino-silicate.

WO9800504 discloses the use of an anionic surfactant as part of the binder system for a bleach activator agglomerate. A wide range of bleach precursors are suggested to be suitable, including TAED. Formulation 4 of Example 1 is a bleach precursor particulate containing 65% TAED, 9.8% sodium linear $C_{12}$ alkyl benzenesulphonate (anionic surfactant), 0.3% $C_{2-4}$predominantly linear primary alcohol condensed with an average of 3 moles of ethylene oxide (nonionic surfactant), 0.96% sodium toluene sulphonate, 11.3% citric acid and 6.2% sodium carboxymethylcellulose, the balance (nearly 6.5%) is water. The only other example using TAED also contains 6.2% sodium carboxymethylcellulose and again contains over 6% water.

We have found that use of TAED powder in a pre-reaction with hydrogen peroxide to form a bleaching solution for use in a pulp bleaching process is undesirable for a number of reasons. Firstly it does not have the required free flow properties to be dosed effectively from a hopper. Secondly it requires special equipment to control dust levels. Thirdly it does not mix well with hydrogen peroxide solution and has poor dispersing and dissolution characteristics. These disadvantages can be overcome by use of an agglomerated product which enables the use of small crystal size TAED without the associated problems of dusting, high risks, poor stability and poor solids handling. These problems and their solution are different from those encountered in the laundry detergent industry. In that case the granulate is not fed from a bulk storage hopper to a reaction vessel, neither is the reaction carried out with so few charged species in solution. For instance a typical laundry detergent containing TAED will also contain sodium perborate, sodium silicate and a sodium salt of anionic surfactant.

Thus we have found that use of agglomerates which are designed for laundry detergent applications leads to several unforeseen problems in a pulp bleaching process. Firstly many of the binders used in laundry applications are insoluble under the pH and temperature conditions under which an agglomerate may need to be pre-reacted with the hydrogen peroxide solution. Secondly, many binders react with the caustic soda added to adjust the alkalinity of the pre-reaction mixture and/or the pulp. This reaction or complexing can form a scum, which is unacceptable for pulp bleaching where residual solid matter must be avoided. Thirdly the binders may give rise to poor pulp bleaching and may even form coloured species under the extremes of one or more of temperature, pressure and residence time encountered in pulp some bleaching processes. Fourthly, the agglomerates made with conventional binder systems to not disperse fast enough or wet fast enough in the low ionic medium of the pre-reaction process.

Following the efforts of the present inventors a range of binders and dispersing systems has been selected which are suited to a process which reacts with TAED with dilute hydrogen peroxide on a large scale for continuous dosing to a pulp bleaching process.

According to the present invention there is provided a process for the bleaching of wood and non-wood pulp comprising the steps of:

a) adding an aliquot of agglomerate from a bulk solids dispersing means, advantageously a hopper, to a dilute solution of hydrogen peroxide which is desirably agitated to keep the agglomerate in suspension, the agglomerate comprising:
   - a bleach activator, advantageously TAED;
   - a peroxide soluble binder, preferably polyvinyl alcohol (PVOH);
   - a dispersing system comprising a wetting agent which is a low foaming and does not discolour on exposure to temperatures of up to 120° C. and optionally a salt, preferably sodium acetate, which is highly soluble in hydrogen peroxide;
   - and sequestrant which may additionally or alternatively be added directly to the hydrogen peroxide;
b) allowing the TAED to substantially completely react with the hydrogen peroxide;
c) adjusting the pH of the bleach solution by adding alkali preferably caustic soda; and
d) bleaching the pulp by contacting it with the bleaching solution under alkaline conditions.

The agglomerate preferably comprises: a TAED agglomerate with average particle size in the range 5 to 2000 micron having a binder system comprising less than 1%, preferably less than 0.5% CMC, most preferably none at all and: 2–8% of anionic surfactant which can be dried to a solid and other ingredients which are non precipitating over a pH range of 5–10, the binder system further being completely compatible with the pulp bleaching process and preferably readily biodegradable.

Surprisingly, although pulp is mainly cellulosic material, we have discovered that the use of a cellulosic binder material is to be avoided because it reacts with other ingredients to form an insoluble scum which cannot be removed during the bleaching process, this is critically important and means that a conventional laundry detergent bleach activator granule such as that disclosed in EP37026 cannot be used for pulp bleaching.

Preferably the anionic surfactant is incorporated at a level of 1 to 6% by weight based on the dry agglomerate, most preferably about 2.5%.

For processing reasons the agglomerate may comprise up to 1% preferably 0.1 to 0.5% by weight based on the dry agglomeration of a co-binder, such as Sodium Carboxymethylcellulose. However, an agglomerate without any CMC is preferred.

Other additives such as flow aids, sequestrants, pH adjusting components, diluents and the like may also be included in the agglomerate as required. The inclusion of one or more sequestrants is particularly advantageous as these are needed to enable any transition metals in the alkali used yo adjust the pH to be rendered non-catalytic for the decomposition of the hydrogen peroxide. If they are not added as part of the agglomerate they need to be added separately to the pre-reaction vessel.

The use of sodium acetate as the salt is preferred because the reaction products of TAED and peroxide may in any case form sodium acetate at neutral pH so the use of this salt does not add to the chemical complexity of the system This can be important for waste treatment. Sodium acetate also has the advantage that the segregation of the agglomerate during transportation and storage is low.

The agglomerates may be manufactured using any process known to those skilled in the art e.g. mixing TAED powder and a solution of surfactant to form agglomerates and drying the agglomerates so formed.

The bleaching solution comprises an oxygen bleach mixture which is advantageously formed by the reaction of the bleach activator dispersed from the agglomerate with a molar excess of hydrogen peroxide over the acetyl groups that are released from the bleach activator, typically a 10:1 excess is used. This provides an advantage over the use of preformed peracid because it eliminates the need to handle the peracid in concentrated form. The pH of the bleaching solution is adjusted by addition of alkali before it is dosed to the pulp.

The preferred bleach activators are solid as this enables the agglomerate to be accurately dosed and allows for easy recovery from accidental spillages.

The peroxide source is hydrogen peroxide. The concentration of hydrogen peroxide in the pre-reaction mixture is normally in the range 0.1 to 60%, preferably 0.2 to 30% w/v. A typical level will be 3%. The amount of bleach activator used in the prereaction mixture should be in the range 0.001 to 20 g/l based on the theoretical dose to dry pulp, although it has been found in practice that production of the reaction product in this way is not very ratio sensitive. When TAED is used as the bleach activator we have found that use of large concentrations of TAED leads to an undesirable exothermic reaction and the maximum concentration that should be used is 10%, preferably 5% and most preferably less than 2%.

In the bleaching tower there should always be an excess of peroxide so that the peracetic acid bleaching complements the bleaching done by the hydrogen peroxide. This is done because the different bleaching species are able to bleach in slightly different ways which gives a synergistic increase in bleaching compared with that which would be obtained from the use of either chemical on its own. Furthermore the powerful nature of the peracid bleach means that a 4:1 molar excess of hydrogen peroxide over peracetic acid gives a reasonable balance in the bleaching contribution of the two components. The initial level of peroxide in the bleaching tower should be in the range 0.5 to 4% depending on the type of pulp and the process being used. The initial level of peracid in the tower will be equivalent to 0.5% bleach activator when TAED is used.

The pulp may be any sort of pulp, including chemical and mechanical pulp and mixtures thereof including recycled material. Wood and non-wood fibres can be bleached using this process. The flexibility of the process according to the invention allows the pH of the incoming oxygen bleach mixture to be adjusted to give the required pH in the pulp/bleach mixture although direct adjustment of the pH of the pulp is also acceptable.

The bleach activator may be any one or mixtures of more than one acetyl donor. Preferably, the activator is one or mixtures of more than one of the compounds of the formula I:

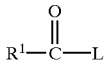

I in which L is a leaving group attached via an oxygen or a nitrogen atom to the C═O carbon atom and $R^1$ is acetyl.

The leaving group L is preferably a group, the conjugate add of which has a $pK_a$ in the range 4 to 13, preferably 7 to 11, most preferably 8 to 11.

Substituents on L can include hydroxyl, ═N—$R^2$ in which $R^2$ is preferably lower alkyl amine, acyl, acyloxy, alkoxy, aryl, aroyl, aryloxy, aroyloxy, halogen, amido, and imido groups and the like as well as other groups not adversely affecting the activity of the activator.

Activators generating peracids other than peracetic acid are either less effective or more costly and are not commercially useful.

Specific activators which are available for use in the invention are tetraacetylethylenediamine (TAED), pentaacetyl glucose (PAG), and tetraacetylglycoluril (TAGU). Of these TAED is preferred because it gives the most cost effective release of acetyl groups: it releases 2 such groups per molecule.

The addition of an alkaline salt such as caustic soda to the mixing stage will inevitably introduce transition metal ions. These are able to catalyse the decomposition of hydrogen peroxide so a sequestrant is used to prevent this. Preferred sequestrants are selected from the group comprising penta methylene phosphonic acid and diethylene triamine penta (methylene phosphonic acid) or DTPA.

The invention will be further described with reference to the following non-limiting examples:

TAED was used as the bleach activator. The $pK_a$ of peracetic acid which is the peracid corresponding to the acyl group of the TAED bleach activator is 8.2.

Pulp brightness is measured with a brightness meter which determines the brightness of a split sheet at a wavelength of 457 nm using a Carl Zeiss Elrepho.

Agglomerates were tested for dispersion in water and production of foam and scum, before being subjected to a mush test which assesses the ability of the agglomerate to be dispensed from a hopper when damp.

Dispersion Testing

A 100 $cm^3$ beaker containing 50 $cm^3$ of tap water at 30° C. on a combination stirrer and hot plate was stirred so that a 1 cm3 vortex was formed. Then a 0.5 g sample of the test agglomerate was added to the vortex and the time taken for the agglomerate to break through the surface was measured ($T_{(Diss)}$). TAED powder does not disperse even after 20 minutes. A laundry detergent agglomerate sold under the trade mark MYKON ATC was used as a comparative example. The dispersion test was then continued by increasing the stirring so that the vortex reached the bottom of the beaker. This stirring was continued for 30 s and then stopped. The foam height was measured as soon as the vortex disappeared and again after 10 s. Any observations of residues or scum formation were also recorded.

Table 1 shows the composition of agglomerates suitable for use in the invention and comparative agglomerates not suitable for use in the inventive process.

TABLE 1

| | Allgomerate reference | | | | | | | | | |
|---|---|---|---|---|---|---|---|---|---|---|
| | A | B | C | D | E | F | G | H | I | J |
| Bleach Activator | T200 | 2710A | 2710B | 2410D | P400 | 2410B | 2410A | 1905C | | |
| TAED | 70 | 70 | 69.7 | 69.1 | 73.8 | 69.7 | 70 | 73.8 | 73.8 | 73.8 |
| Binder | | | | | | | | | | |
| PVOH | | | | | 0.8 | | | 0.8 | 0.8 | 0.8 |

TABLE 1-continued

| | | | | | | | | | | |
|---|---|---|---|---|---|---|---|---|---|---|
| CMC | 1 | 1 | 1 | 1 | 1.1 | 1 | 1 | 1.1 | 1.1 | 1.1 |
| Sodium Citrate | | | 0.3 | | | | | | | |
| Sodium Acetate | | | | 1.3 | | | | | | |
| Sodium Chloride | | | | | | 0.3 | | | | |
| Wetting Agent | | | | | | | | | | |
| KFAS | 2.5 | 2.0 | 2.0 | 2.0 | 2.3 | 2.0 | 2.0 | 2.3 | 2.3 | 2.3 |
| Salt | | | | | | | | | | |
| Sodium Sulphate | 26.5 | | | | | | | | | |
| Sodium Acetate | | | | 26.6 | 21.8 | | | | | |
| Sodium Citrate | | 27 | 27 | | | | | | | |
| Sodium Chloride | | | | | | 27 | 27 | | | |
| Trisodium Citrate | | | | | | | | 21.8 | | |
| Potassium Acetate | | | | | | | | | 21.8 | |
| Tripotassium Citrate | | | | | | | | | | 21.8 |

| | Allgomerate reference | | | | | | | | | | |
|---|---|---|---|---|---|---|---|---|---|---|---|
| | K | L | M | N | O | P | Q | R | S | T | U |
| Bleach Activator | | | 0906C | 0906B | 0906A | ATC | 2005B | 0412B | 1809A | 2511B | P410 |
| TAED | 73.8 | 73.8 | 73.8 | 73.8 | 73.8 | 92.0 | 95.6 | 73.8 | 70 | 76.7 | 70 |
| Binder | | | | | | | | | | | |
| PVOH | 0.8 | 0.8 | 0.8 | 0.8 | 0.8 | | 0.8 | 0.8 | | | 0.8 |
| SCMC | 1.1 | 1.1 | 1.1 | 1.1 | 1.1 | 7.0 | 1.1 | 1.1 | 1.0 | 1.0 | |
| SLES | | | | | | | | | 2.5 | | |
| Wetting Agent | | | | | | | | | | | |
| KFAS | 2.3 | 2.3 | 2.3 | 2.3 | 2.3 | | 2.3 | | | 1.5 | 2.3 |
| PA | | | | | | | | 2.3 | | | |
| SLES | | | | | | | | | 2.5 | | |
| Salt | | | | | | | | | | | |
| Sodium Sulphate | | | | | | | | | 26.5 | | |
| Sodium Acetate | | | | | | | | 21.8 | | 20.8 | 26.9 |
| Tripotassium Citrate | | | | | | | | | | | |
| Sodium Tartrate | 21.8 | | | | | | | | | | |
| Magnesium Acetate | | 21.8 | | | | | | | | | |
| Magnesium Oxide | | | 21.8 | | | | | | | | |
| Calciun Lactate | | | | 21.8 | | | | | | | |
| Calcium Gluconate | | | | | 21.8 | | | | | | |

PVOH is polyvinyl alcohol
SLES is sodium lauryl ether sulphate
KFAS is a potassium salt of fatty acid sulphate
SCMC is sodium carboxymethyl cellulose
TAED is tetraacetyl ethylenediaimne
PA is a polyacrylate wetting agent sold under the trade name Dispex N40

EXAMPLE 1

Agglomerates were tested for their dispersion and foaming characteristics according to the test described above. Zero foam is regarded as a pass. Table 2 shows the results, a fail is awarded to any agglomerate which fails to disperse in 10 seconds or less.

TABLE 2

| Agglomerate | Dispersion Test | foam/residue |
|---|---|---|
| P (comparative) | Fail | scum formed |
| H | Borderline | no foam, no residue |
| Q | Pass | no foam, no residue |
| E | Pass | no foam, no residue |
| O | Pass | white powder residue |
| N | Borderline | white powder residue |
| M | Pass | white powder residue |
| E | Pass | No scum no foam |
| R | Fail | Slow dissolution, some foam and scum |
| S | Fail | Instant dissolution, considerable foam. No scum |

EXAMPLE 2

Agglomerates were tested for their ability to be dispensed from a hopper under humid conditions. Those that passed that test were then reacted with hydrogen peroxide to determine the peracid release. A pass was anything over 80% of the theoretical release. Results are given in Table 3.

TABLE 3

| Agglomerate | Flow properties | Peracid release |
|---|---|---|
| P (comparative) | good | good |
| E | good | good |
| H | poor | poor |
| I | poor | — |
| J | good | poor |
| K | poor | — |
| L | poor | poor |
| M | good | poor |
| N | good | poor |
| O | good | poor |

EXAMPLE 3

Bleaching studies were performed on partially delignified and bleached pulp samples which had been subjected to an O-D-E sequence. A $P_A$ stage was then performed using the following agglomerates A, T and E. Agglomerate A is included for comparative purposes as it is not suitable for the process according to the present invention due to high amounts of segregation during bulk handling and dosing to the prereaction mixture. This difficulty was eliminated in our trials by special handling procedures but these would not be commercially viable.

All pulp had an initial consistency of 10%. Bleaching was done in a mixed peracetic/peroxide stage ($P_A$) using a pre-reacted bleaching solution made by reacting TAED delivered from an agglomerate according to the invention with hydrogen peroxide at 80° C. for 1 hour in the presence of a sequestrant (Dequest 2066). The TAED to peroxide ratio used in the pre-reaction was 1:1 by weight and the total bleaching solution dose (actives) was set at 1% based on dry weight of pulp. Initial pH was 8 and initial pulp brightness before $P_A$ bleaching was 75%ISO in each case. Brightness and physical strength data are given in Table 4.

TABLE 4

| Agglomerate | A | T | E |
|---|---|---|---|
| ISO Brightness (%) | 84.6 | 85.1 | 84.8 |
| Freeness C.S.F (ml) | 456 | 436 | 465 |
| Tensile Index ($Nmg^{-1}$) | 41.5 | 43.1 | 42.4 |
| Tensile Breaking Length (m) | 4232 | 4396 | 4319 |
| Tear Index ($mNm^2g^{-1}$) | 7.5 | 7.5 | 7.5 |
| Burst Index ($kPam^2g^{-1}$) | 2.46 | 2.56 | 2.37 |
| Opacity (%) | 82.62 | 81.60 | 83.84 |
| Apparent Bulk ($cm^3/g$) | 1.61 | 1.59 | 1.61 |
| Apparent Bulk Density (g/cm3) | 0.62 | 0.63 | 0.62 |
| Moisture (%) | 7.6 | 7.7 | 7.2 |
| Stretch (%) | 3.3 | 3.1 | 3.0 |
| Grammage (air dry) ($g/m^2$) | 64.1 | 63.4 | 69.7 |

Comparable pulp strength values and brightnesses were obtained from each TAED agglomerate.

No dispersion or excessive foaming problems were encountered in preparing the pre-reacted solutions using any of the agglomerated products.

EXAMPLE 4

Bagasse chemical pulp was bleached using a C-EQ-$P_A$ sequence. The $P_A$ stage was carried out at 60° C. using a prereaction system which used 0.5% hydrogen peroxide reacted with 0.5% of agglomerate E dispensed from a hopper. The bleach was added to the pulp at a pH of 8.51 and the ISO brightness obtained was 79.5. Similar results were obtained using agglomerate U.

What is claimed is:

1. A process for the bleaching of wood and non-wood pulp comprising the steps of:

a) adding an aliquot of agglomerate from a bulk solid dispensing means to a dilute solution of hydrogen peroxide, wherein the agglomerate comprises:
a bleach activator;
a peroxide soluble binder;
a dispersing system comprising a wetting agent which is low foaming and does not discolour on exposure to temperatures of up to 120° C. and optionally a salt, which is highly soluble in hydrogen peroxide; and
wherein the amount of hydrogen peroxide is more than twice that which can react with the activator;

b) allowing the bleach activator to substantially completely react with the hydrogen peroxide in the presence of a sequestrant which is provided in the agglomerate and/or the dilute hydrogen peroxide to generate a peroxyacid based oxygen bleaching species in a bleaching solution;

c) adjusting the pH of the bleach solution by adding alkali; and d) bleaching the pulp by contacting it with the bleaching solution under alkaline conditions.

2. A process according to claim 1 wherein the bleach activator comprises acetyl groups and reacts with hydrogen peroxide to produce peracetic acid, and wherein the molar ratio of hydrogen peroxide to available acetyl groups in at least 3.35:1.

3. A process according to claim 1 wherein the binder includes no more than 1.1% cellulosic material as a percentage of the agglomerate.

4. A process according to claim 1 in which the bulk solid dispensing means is a hopper.

5. A process according to claim 1 which the alkali is caustic soda.

6. A process according to claim 1 in which the bleach activator it TAED.

7. A process according to claim 1 in which the total binder content in the agglomerate comprises less than 3% by weight.

8. A process according to claim 1 in which at least 25% of the total binder content comprises polyvinyl alcohol.

9. A process according to claim 1 wherein said bleach activator comprises a compound having a formula of:

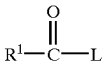

wherein $R^1CO$ is an acetyl group and L is a leaving group attached via an oxygen or a nitrogen atom to the C═O carbon atom.

10. A process for the bleaching of wood and non-wood pulp comprising the steps of:

a) adding an aliquot of agglomerate from a bulk solid dispensing means to a dilute solution of hydrogen peroxide, wherein the agglomerate comprises:
a bleach activator;
a peroxide soluble binder including no more than 1.1% cellulosic material as a percentage of agglomerate;
a dispersing system comprising a wetting agent which is low foaming and does not discolour on exposure to temperatures of up to 120° C. and optionally a salt, which is highly soluble in hydrogen peroxide; and
wherein the amount of hydrogen peroxide is more than twice that which can react with the activator;

b) allowing the bleach activator to substantially completely react with the hydrogen peroxide in the presence of a sequestrant which is provided in the agglomerate and/or the dilute hydrogen peroxide to generate a peroxyacid based oxygen bleaching species in a bleaching solution;

c) adjusting the pH of the bleach solution by adding alkali; and d) bleaching the pulp by contacting it with the bleaching solution under alkaline conditions.

* * * * *